United States Patent [19]

Geitner

[11] 4,381,632

[45] May 3, 1983

[54] SNAP-LOCK HOUSING CONSTRUCTION AND PARTS THEREOF

[75] Inventor: Lawrence J. Geitner, Angola, N.Y.

[73] Assignee: Buffalo Forge Company, Buffalo, N.Y.

[21] Appl. No.: 167,209

[22] Filed: Jul. 9, 1980

[51] Int. Cl.[3] ..... E04B 1/38

[52] U.S. Cl. ..... 52/262; 50/264; 50/280; 50/282

[58] Field of Search ..... 52/586, 280, 579, 580, 52/594, 582, 593, 595, 393, 402, 398, 399, 280, 281, 282, 262, 264

[56] References Cited

U.S. PATENT DOCUMENTS

| | | | |
|---|---|---|---|
| 3,055,468 | 9/1962 | Horejs | 52/731 |
| 3,160,249 | 12/1964 | Pavlecka | 52/586 |
| 3,310,926 | 3/1967 | Brandreth . | |
| 3,452,501 | 7/1969 | Zimmer | 52/582 |
| 3,605,363 | 9/1971 | Bard | 52/584 |
| 3,755,978 | 9/1973 | Jackson | 52/595 |
| 3,798,862 | 3/1974 | Stoakes | 52/397 |
| 3,858,377 | 1/1975 | Browne | 52/731 1 |
| 3,862,523 | 1/1975 | Eaton | 52/586 |
| 3,866,381 | 2/1975 | Eschbach | 52/584 |

FOREIGN PATENT DOCUMENTS

| | | | |
|---|---|---|---|
| 2559336 | 7/1977 | Fed. Rep. of Germany | 52/393 |

*Primary Examiner*—John E. Murtagh

*Attorney, Agent, or Firm*—Joseph P. Gastel

[57] ABSTRACT

A housing structure consisting of a plurality of wall panels connected to each other by mullions with a snap-locking engagement, with the side walls connected to each other at their corners by corner posts with a snap-locking engagement, and a roof consisting of a plurality of panels snapped together by means of mullions with a snap-locking engagement, a snap-locking connection between the roof and the side walls and a snap-locking connection between the side walls and the base.

17 Claims, 15 Drawing Figures

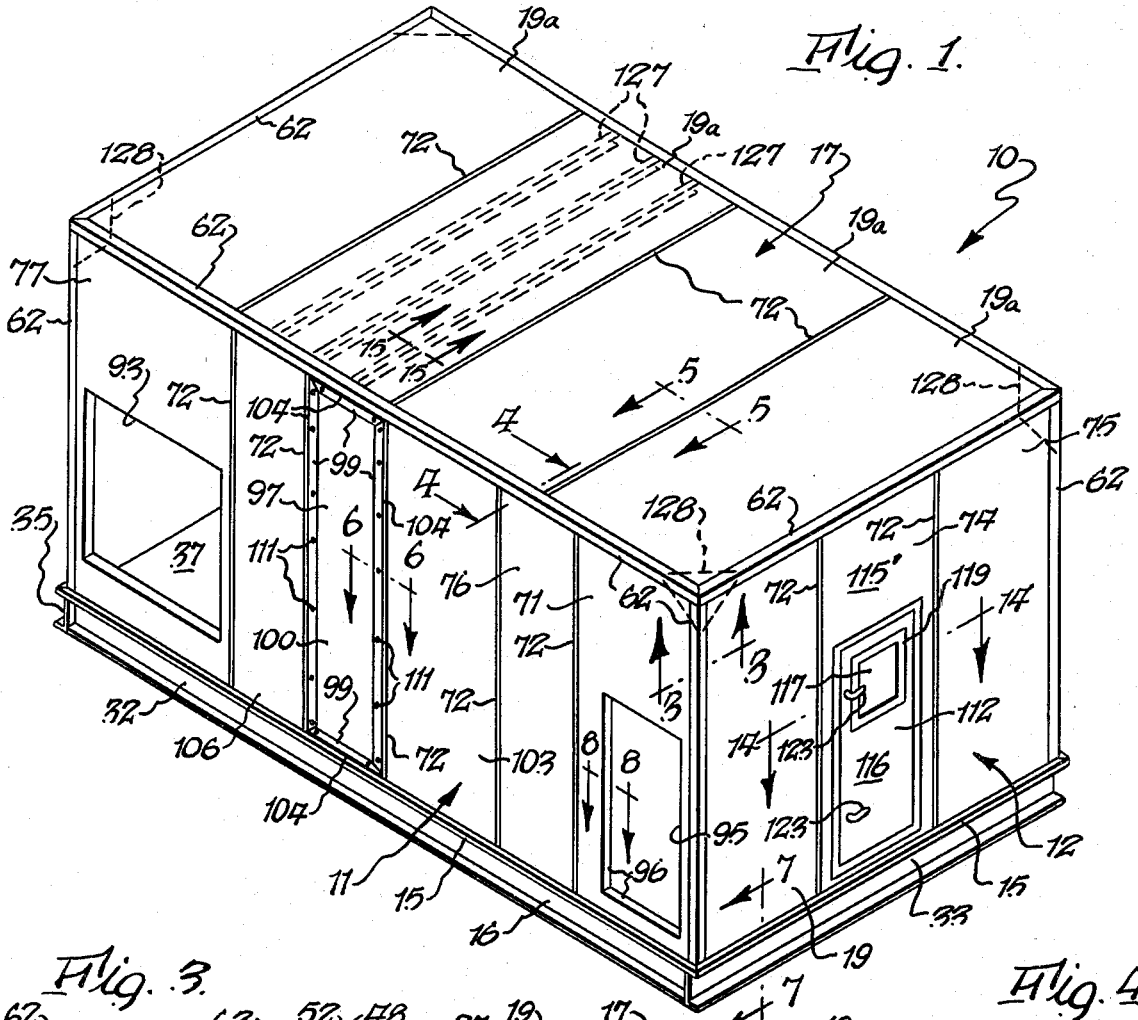
Fig. 1.
10
11
12
14
15
16
17
19
19a
32
33
35
37
62
72
74
75
76
77
93
95
96
97
99
100
103
104
106
111
112
115'
116
117
119
123
127
128
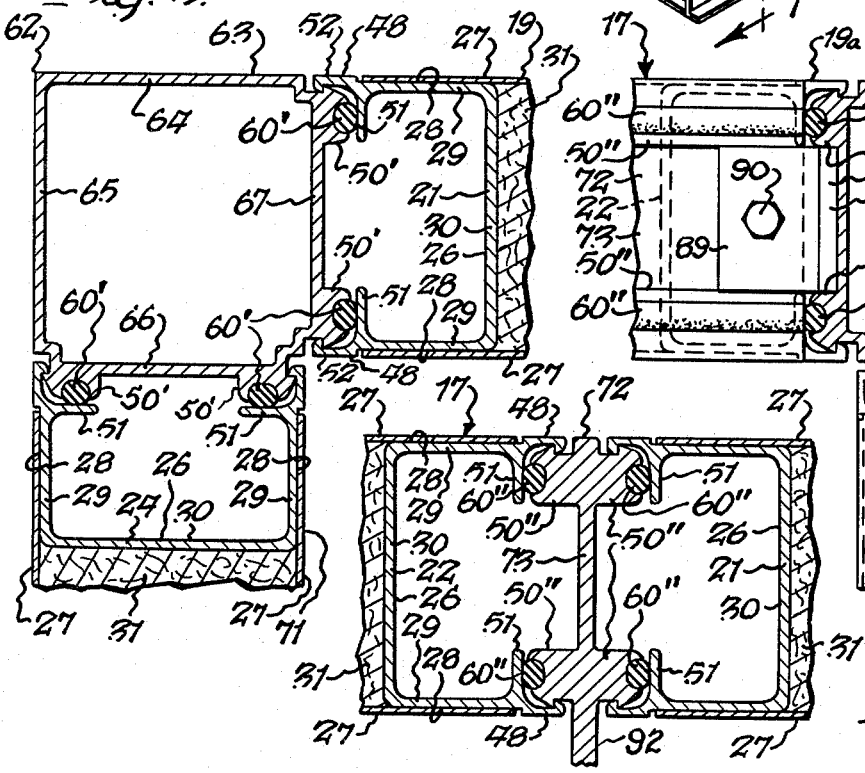
Fig. 3.
Fig. 4.
Fig. 5.
17
19
19a
21
22
24
26
27
28
29
30
31
48
50'
50"
51
52
60'
60"
62
63
64
65
66
67
69
71
72
73
76
87
90
91
92

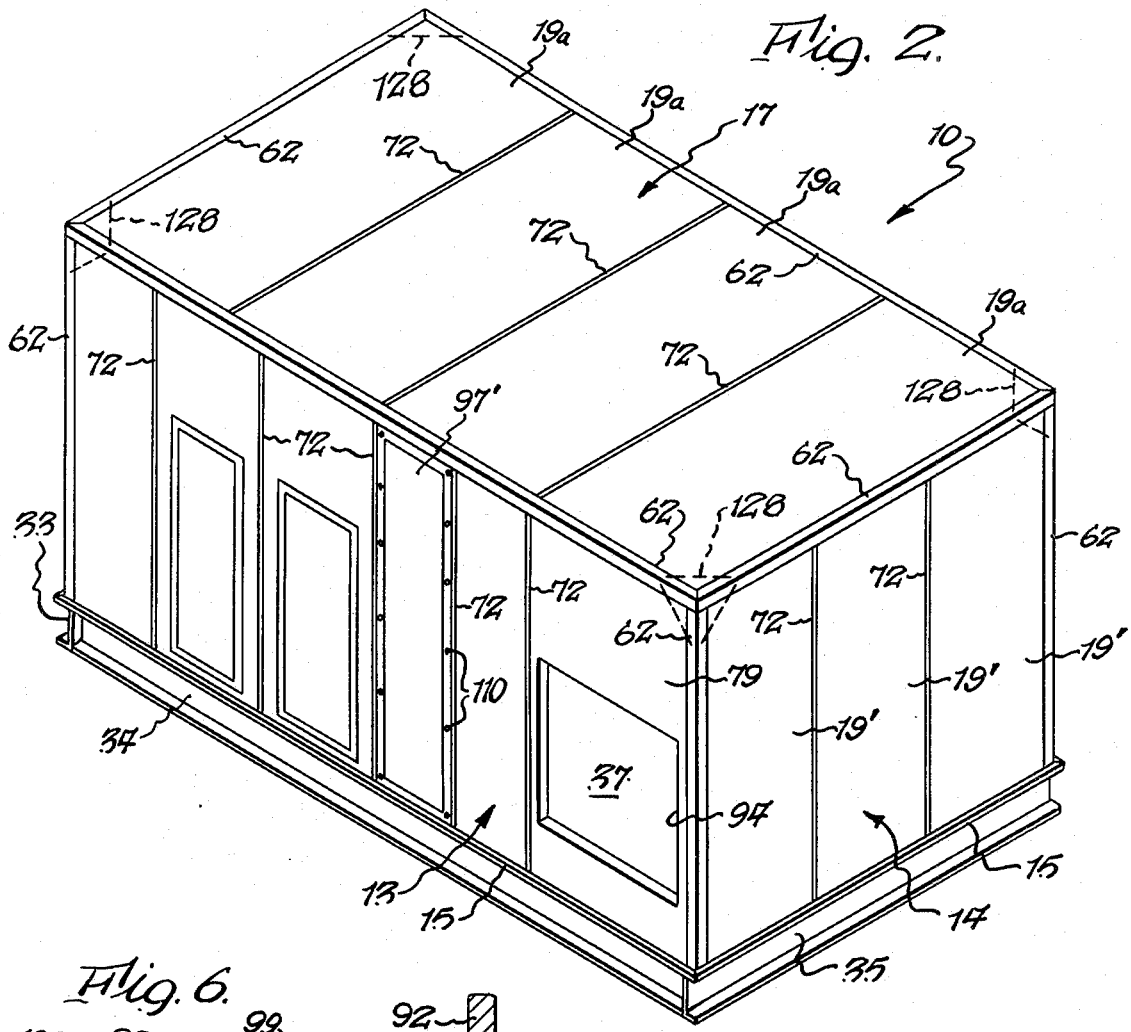
Fig. 2.
10
17
19a
12B
62
72
97'
33
34
37
110
79
19'
97
13
15
14
35
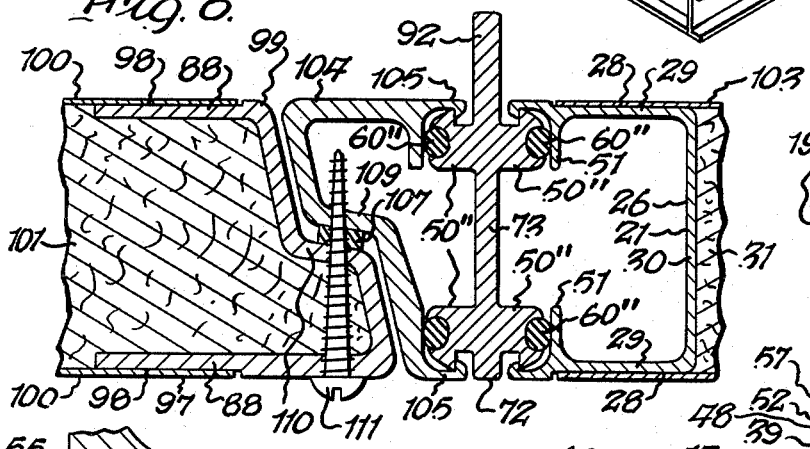
Fig. 6.
100
98
88
99
104
105
92
28
29
103
60"
51
50"
109
107
101
73
26
21
30
31
97
110
111
72
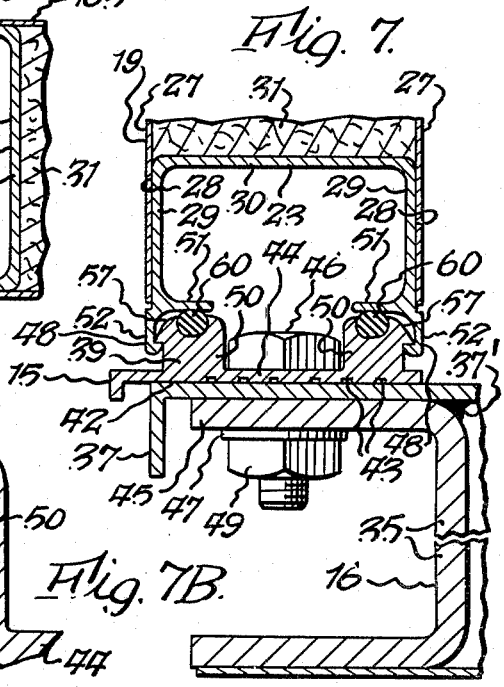
Fig. 7.
19
27
31
28
29
30
23
57
60
50
44
46
52
39
15
42
37
48
43
45
47
49
35
16
Fig. 7B.
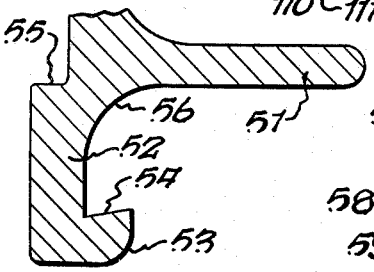
55
56
51
52
54
53
Fig. 7A.
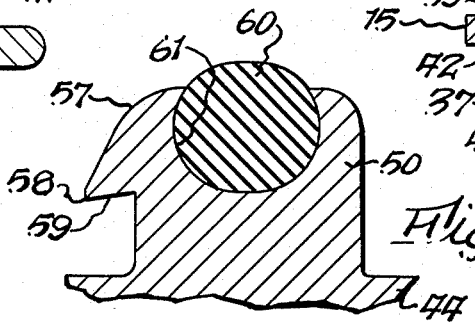
60
61
57
58
59
50
44

10
17
62
83
86
84
85
50'
78'
19
50'
60'
78'
25
24
25
22
72
25
24
25
22
62
60"
60"
60'
50"
50"
60'
81
20
20
62
50'
27
27
50'
80
69
69
15
78
21
25
23
25
60
21
25
23
25
78
42
39
50
37
45
82
33
34
32
35

SNAP-LOCK HOUSING CONSTRUCTION AND PARTS THEREOF

BACKGROUND OF THE INVENTION

The present invention relates to a housing construction which is fabricated from panels which are snap-locked into engagement with each other, and to parts of such construction.

By way of background, for various reasons it is desirable to fabricate housing structures for enclosing various types of equipment. Certain of these housings have been fabricated in the past by attaching prefabricated panels to each other in side-by-side relationship. Structures of this type are shown in U.S. Pat. Nos. 3,192,671 and 3,310,926. However, the panels were attached to each other by conventional mechanical fasteners and/or cement, which was time-consuming and expensive. It is with overcoming the foregoing deficiencies of prior art housing structures that the present invention is concerned.

SUMMARY OF THE INVENTION

It is accordingly one object of the present invention to provide an improved housing construction fabricated from panels which are snap-locked into engagement with each other. A related object of the present invention is to provide an improved housing construction in which the panels are not only snap-locked into engagement with each other but also with the base on which they are mounted, and, in addition, with the roof of the structure, which is also constructed from panels which are snap-locked into engagement with each other.

Another object of the present invention is to provide an improved mullion which includes a snap-locking construction so that it can be snap-locked into engagement with adjacent panels. Other objects and attendant advantages of the present invention will readily be perceived hereafter.

The present invention relates to a housing structure comprising a plurality of panels having first snap-locking means on a plurality of sides thereof for providing locking engagement with adjacent members, mullion means for interposition between adjacent panels, second snap-locking means on said mullion means for coacting with said first snap-locking means on adjacent panels so as to effect locking of said adjacent panels to each other. In its more specific aspects, a roof is also provided having third snap-locking means for receiving first snap-locking means on second sides of said panels in locking engagement. In its still further aspects, the panels include third snap-locking means on lower sides thereof for locking engagement with a base.

The present invention also relates to a mullion comprising a central body portion, and first and second snap-locking means extending outwardly from opposite sides of said central body portion for attaching said mullion to adjacent members with a locking connection.

The present invention also relates to a panel frame member comprising a channel including a web and a pair of substantially parallel legs extending outwardly from said web, flange means spaced from said web and extending inwardly toward each other from said legs for providing sealing engagement with an adjacent member, and snap-locking means for locking engagement with an adjacent member comprising second flange means attached to said legs on the opposite sides of said flange means from said web.

The various aspects of the present invention will be more fully understood when the following portions of the specification are read in conjunction with the accompanying drawings wherein:

BRIEF DESCRIPTION OF THE DRAWINGS

FIG. 1 is a perspective view of the improved housing structure which is assembled entirely by snap locking connections, this view being taken from one corner of the housing;

FIG. 2 is a view similar to FIG. 1 but taken from the opposite corner of the housing;

FIG. 3 is a fragmentary cross sectional view taken substantially along line 3—3 of FIG. 1 showing the manner in which the side panels are joined at a corner;

FIG. 4 is a fragmentary cross sectional view taken substantially along line 4—4 of FIG. 1 and showing the manner in which the roof mullions and the side wall mullions are mounted relative to the corner extrusion which forms the border of the roof;

FIG. 5 is a fragmentary cross sectional view taken substantially along line 5—5 of FIG. 1 and showing the mullion construction by which roof panels are attached to each other;

FIG. 6 is a fragmentary cross sectional view taken substantially along line 6—6 of FIG. 1 and showing the construction for mounting a removable panel between two side panels;

FIG. 7 is a fragmentary cross sectional view taken substantially along line 7—7 of FIG. 1 and showing the construction for mounting the casing sill on the channel frame which forms the base and the structure for attaching the side panels to the casing sill;

FIG. 7A is an enlarged fragmentary view of the latching flange portion of the panel frame;

FIG. 7B is an enlarged fragmentary view of the rib on the casing sill which coacts with the latching flange;

DETAILED DESCRIPTION OF THE PREFERRED EMBODIMENTS

Figure 15:
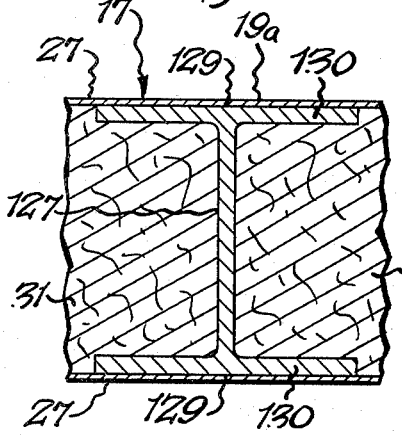
FIG. 15 is a fragmentary cross sectional view taken along line 15—15 of FIG. 1 and showing the structure of the panel brace.

Summarizing briefly in advance, the improved housing 10 of the present invention consists of four sides 11, 12, 13 and 14, each of which are fabricated from a plurality of panels which are locked to each other by snap connections and to a casing sill 15 secured to base 16 fabricated from channel members. A roof 17 is also fabricated from a plurality of panels which are locked in side-by-side relationship by snap connections, and the roof as a unit is locked by snap connections to the tops of the side walls 11, 12, 13 and 14. Because of the use of snap-locking connections, the housing 10 can be assembled quickly and relatively easily without using conventional fasteners for the side walls and the roof.

Each conventional side panel, such as 19 (FIGS. 1, 3 7 and 13), consists of a frame 20 fabricated from panel frame extrusions 21, 22, 23 and 24 which are joined at the corner of the panel by mitered joints at 25. The typical cross section of a panel frame extrusion is shown at 26 in FIG. 3. Sheet metal skins 27 are secured, as by adhesive, to the outside surfaces 28 of leg portions 29 which extend outwardly from web 30 of frame member 23 (FIG. 7). The space in the panel between webs 30 and skins 27 is filled with suitable insulating material 31, which may be fiberglass or any other suitable type of insulation. As can be seen from the drawing, the panels which form the sides and the roof of housing 10 come in different widths, but they all have the identical panel frame extrusions at their outer edges, and the corners are mitered. The panels may differ from each other, either in size or in the type of opening which they have therein, and these features will be discussed at appropriate points hereafter.

Figure 9:
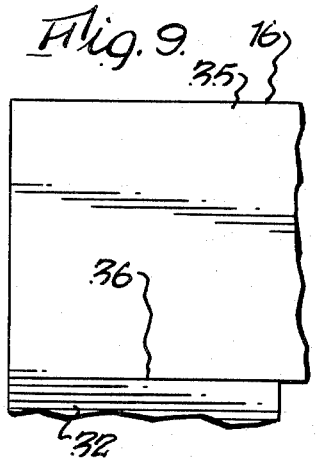
FIG. 9 is a fragmentary plan view of the mitered joint between adjacent channels which form the base.
Figure 10:
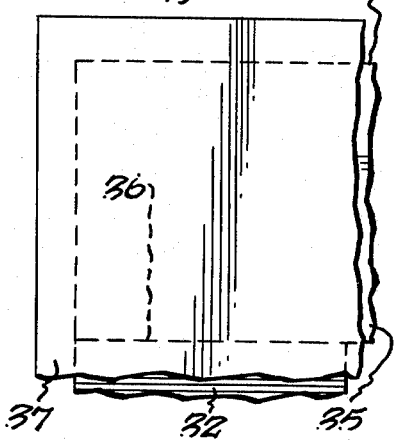
FIG. 10 is a fragmentary plan view similar to FIG. 9 but showing the floor covering the channels.
Figure 11:
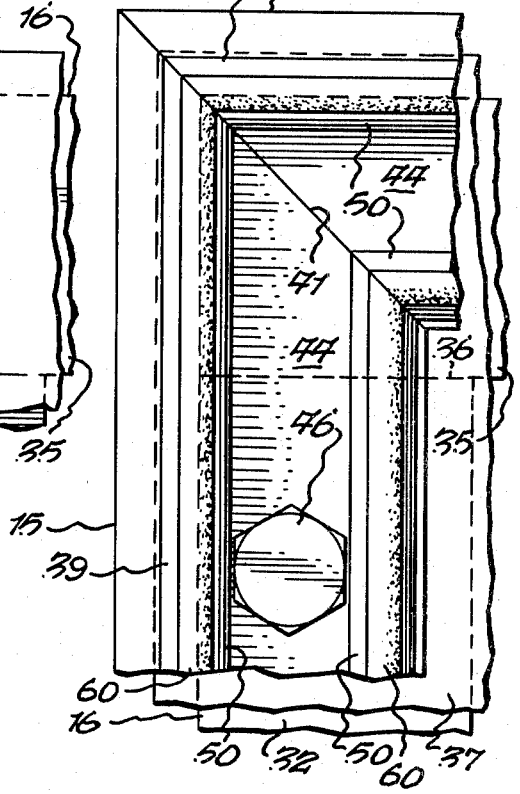
FIG. 11 is a view similar to FIG. 10 but showing the casing sill in position on the floor and the channels and showing the mitered joint at the sill corner.

In order to construct housing 10, the first step is to lay out a base 16 consisting of a plurality of channel members 32, 33, 34 and 35 (FIGS. 1 and 2) which are secured at their corners by a suitable butt joint, such as 36 (FIG. 9), which may be a welded or otherwise suitably attached joint. Thereafter, a suitable floor 37 is layed on the channel frame 16 and is welded to the frame at spaced locations at 37'. The next step is to mount a casing sill 15 (FIGS. 7, 11 and 13) on floor 37. The casing sill 15 consists of extruded metal members 39 having a cross sectional configuration as shown in FIG. 7. The casing sill extrusions 39 are cut to length and are joined by mitered joints, such as 41 (FIG. 12), at their corners. Suitable sealer is applied between the top of floor 37 and the underside 42 of the casing sill. Grooves 43 are provided in the underside 42 to receive the sealant, to thereby provide protection against leakage. It will be understood that grooves 43 extend longitudinally throughout the casing sill extrusion.

To secure the casing sill 15 to the channel frame 16, after the entire sill 15 has been located in the desired position, holes are drilled through the web 44 (FIG. 7) of the casing sill, the floor 37, and the upper leg 45 of the channel 35 and the other channels in the frame. Thereafter, bolts 46 are dropped through the aligned holes which have been formed, a washer 47 is slipped onto the bolt shank and nut 49 is finger-tightened. It will be appreciated that bolts, such as 46, are secured along the entire casing sill, and preferably are positioned on about 12" centers. As noted above, the tightening of nuts 49 to a finger-tight condition permits a certain flexibility of the casing sill during subsequent assembly operations. It is only after the housing has been completely assembled that nuts 49 are wrench-tightened. It is to be noted that the hexagonal heads of bolts 46 fit between upstanding snap-locking ribs 50 of the casing sill extrusions, to thereby hold the bolts 46 against turning during tightening of nuts 49.

After the sill 15 has been laid and secured to the base 16, a panel, such as 19 (FIGS. 1, 7 and 13), is secured to the sill by means of a snap-locking connection after elongated round gasket strips 60 are laid in grooves 61. In this respect, side panel 19 has a lower frame extrusion 23 of the configuration shown in FIG. 7. Flanges 51 extend inwardly from legs 29, and flanges 52, which are essentially latch means, extend substantially perpendicularly to flanges 51 and they are generally in line with legs 29. At the outer end of each flange 52 there is a curved surface 53 and a straight surface 54 which extends transversely to flange 52, as shown in FIG. 7A to provide an interference angle for good latch gripping. The outer surfaces 28 of legs 29 are relieved so as to be spaced inwardly from the outer surfaces 48 of flanges 52. This causes surfaces 48 to be flush with the outsides of panel skins 27. The amount of relieving is represented by the length of side 55 in FIG. 7A. There is a fillet at 56. As a result of the length of legs 29, and as a result of the flexibility of the material, which is extruded aluminum, the legs 29 and skin 27 can flex during the snap-locking action, to thereby open flanges 52 to permit them to slide over surfaces 57 of ribs 50 and then spring back to provide a latching engagement. The ribs 50 of casing sill extrusion 39 each have a curved surface 57 on the outer edge thereof. Stated otherwise, when the lower panel frame, such as 23, is caused to bear down on sill 39, curved surfaces 53 of flanges 52 will ride along curved surfaces 57 of ribs 50 to provide a camming action tending to spread flanges 52 until such time as planar surfaces 54 (FIG. 7A) snap or latch into locking engagement with planar surfaces 59 (FIG. 7B) to thereby hold panel 19 securely on sill 39. The junction 58 between surfaces 57 and 59 is essentially a ridge. Flanges 51 bear on gaskets 60 to provide a sealed connection at the snap-lock joint.

The gasket seals 60 are dimensioned relative to the remainder of the structure so that they will be compressed throughout their length after snap-locking has been effected. Because of this, a good tight leakproof joint is obtained at the latching connections. The compression of the gaskets provides a minimum preload to obviate any looseness at the joint and also compensates for any misalignment between the parts.

Figure 12:
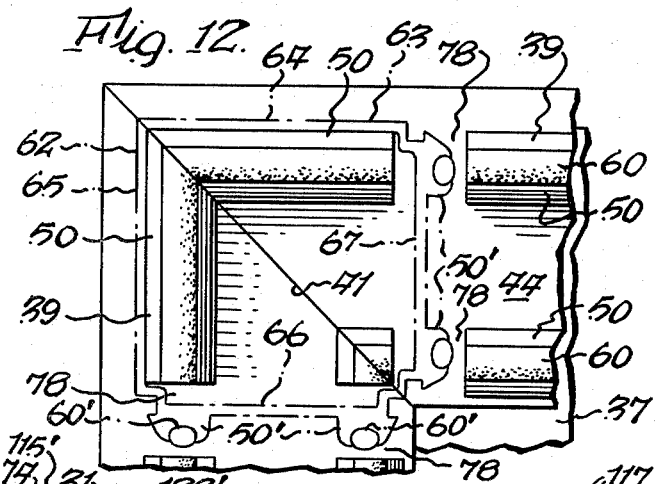
FIG. 12 is a fragmentary cross sectional view looking downwardly on the corner of the housing and showing the relationship between the corner extrusion and the casing sill.
Figure 13:
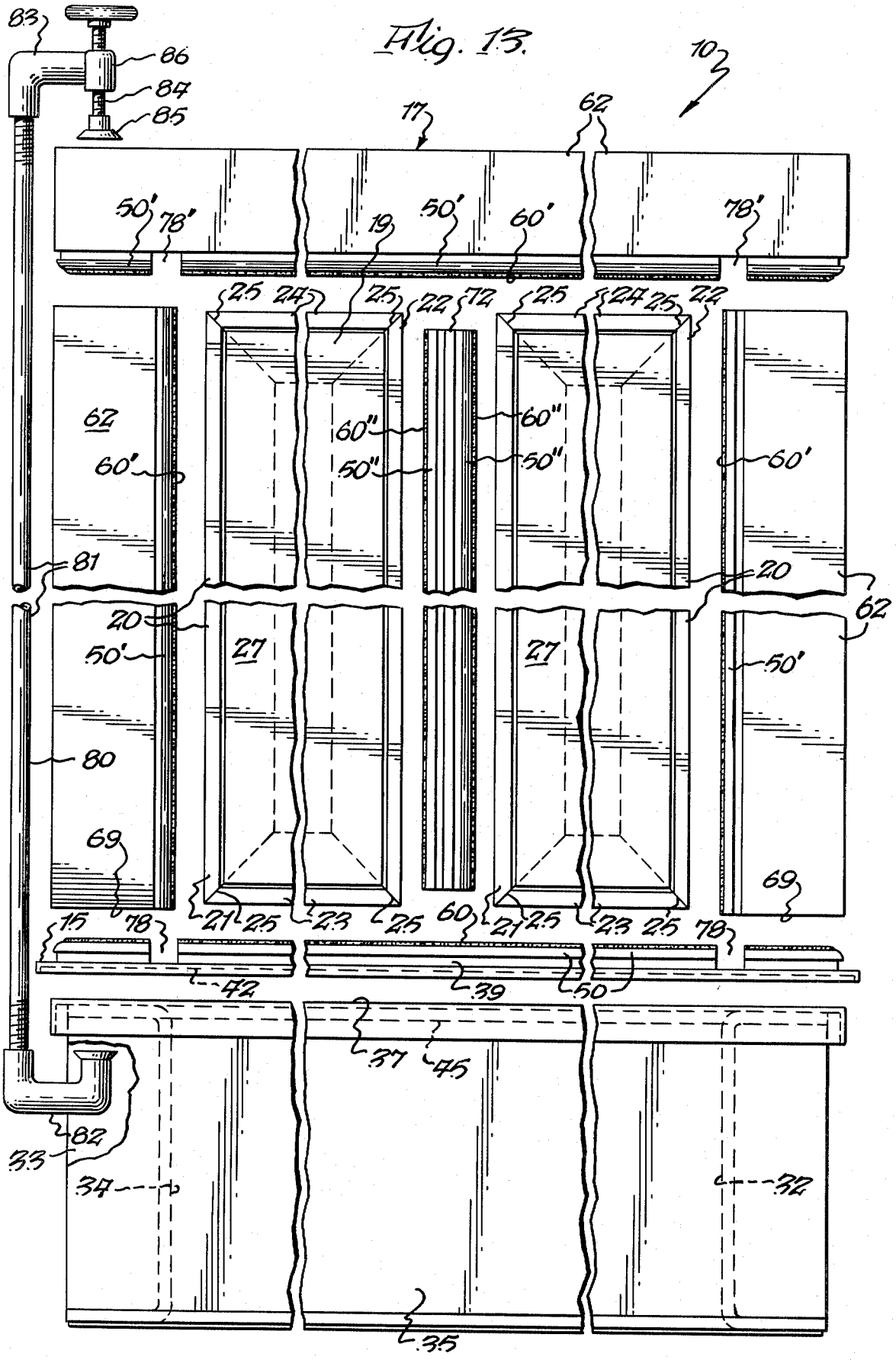
FIG. 13 is a fragmentary exploded view of the various parts and showing the manner in which the roof is assembled onto the side walls and the side walls onto the sill and base.

After panel 19 (FIG. 1) has been placed in position at the corner, a corner extrusion, such as 62 (FIG. 3), is snapped into locking engagement with the panel frame extrusion 21 of panel 19 (FIGS. 3 and 13). At this point it is to be noted that all corner extrusions 62 used at the corners of the walls and at the junction of the walls and roof are identical in cross section. Each corner extrusion comprises an elongated tubular section 63 which is substantially square in cross section and includes side walls 64, 65, 66 and 67. Extending outwardly from walls 66 and 67 are ribs 50' which are substantially identical in all respects to ribs 50 described above in FIGS. 7 and 7B and which carry elongated gaskets 60' which are identical to gaskets 60. Ribs 50' differ from ribs 50 in that the space between the latter is smaller so as to abut the opposite sides of the bolt heads. In other words, the ribs 50 are wider than ribs 50'. Thus, when the corner extrusion is snapped into the panel frame extrusion 21 of panel 19, an interlocking snap-connection will be provided which is identical to that described above relative to FIG. 7. Initially, the corner extrusion 62 will be located so that it is at an elevation with its lower edge 69 (FIG. 13) located above sill 15. To provide clearance for ribs 50' of the corner extrusion 62, ribs 50 of the casing sill are cut away at 78, as shown in FIGS. 12 and 13, so that corner extrusion 62 can be pulled downwardly so that its lower edge 69 rests on floor 37. If desired, corner extrusion 62 may be assembled with panel 19 (FIG. 1) before panel 19 is mounted on casing sill 39, and it may be thereafter pulled down into position.

After the foregoing steps, a panel, such as 71 (FIGS. 1 and 3), is snap-locked into engagement with the other side of corner extrusion 62. This action can be effected because the ribs 50' on the exposed side of corner extrusion 62 can be placed in snap-locking engagement with flanges 52 of panel 71 because the snap-locking structure is identical to that described above relative to FIG. 7, and so is the snap-locking action. It will be appreciated that the snap-locking must be effected when the bottom of panel 71 is elevated above ribs 50 of sill casing 39. However, after snap-locking has been effected with corner extrusion 62, panel 71 is pulled downwardly until its lower edge moves into snap-locking engagement with the sill extrusion, in the same manner as described above relative to FIG. 7.

Once panels 19 and 71 have been assembled in the above-described manner, they will remain in free standing condition because they are both joined at their bottoms to casing sill 15 and to each other by corner extrusion 62, and further because they extend at right angles to each other. Thereafter, sides 11, 12 and 13 of the housing are assembled in modular fashion. In this respect, for example, a mullion 72, such as shown in FIGS. 1, 5, 6 and 13, is snapped into locking engagement with the side of panel 19. In this respect, mullion 72 includes a web or body portion 73 and snap-locking ribs 50'' extending outwardly from opposite ends of the web. Ribs 50'' are identical in construction to latching ribs 50 (FIGS. 7 and 7B). Gasket material 60'' is located in grooves in snap-locking ribs 50'' in an identical manner as described above relative to FIG. 7B. After mullion 72 has been snapped into position, a panel, such as 74, is snapped into mullion 72, and thereafter panel 74 is pulled downwardly until its bottom edge snaps into locking engagement with the casing sill. Thereafter, another mullion 72 is snapped into locking engagement with panel 74 and a panel 75 is snapped into locking engagement with mullion 72. Thereafter, a corner extrusion 62 is snapped into locking engagement with panel 75 and this procedure is the same as described above relative to the first corner extrusion 62. In the same manner, a mullion 72 is snapped into locking engagement with panel 71, and a panel 76 is snapped into locking engagement with mullion 72 and pulled downwardly into locking engagement with the casing sill. This process is repeated with each panel until sides 11, 12 and 13 are completely assembled. As noted above, while the panels may differ in size, or may have different types of openings therein, their outer edges consist of panel frame extrusions for snap-locking engagement with mullions, corner extrusions, and the casing sill.

The next step is to assemble end wall 14 (FIG. 2) into the housing. In order to do this, panels, such as 19', are assembled in snap-locking relationship on the floor with mullions 72 therebetween and with corner extrusions 62 snap-locked to the outer edges thereof. Panels 19' may be identical in all respects to panels 19 described above relative to FIGS. 3 and 13. Thereafter, the entire side wall 14 is moved into the position shown in FIG. 2 so that corner extrusions 62 may be snap locked into engagement with the panel frame extrusions on panels 77 and 79. Thereafter, the entire side wall 14 is pulled downwardly so that its lower edges snap-lock into engagement with the ribs on the casing sill, in the same manner described above relative to FIG. 7.

At this point the housing consists of four free standing walls 11, 12, 13 and 14 connected to each other at their corners. The roof 17 is then mounted onto the walls. The roof 17 is assembled away from the housing, preferably on a floor or the like, by snap-locking panels **19*a* to each other by means of mullions 72 in the same manner as described above inasmuch as the mullions may be identical to those shown in FIG. 6 and the roof panels 19*a* have panel frame structure which is identical to the panels 19 described above. After the assembling of panel 19*a* and mullions 62 has been completed, corner extrusions 62 are assembled on the outer edges of the joined panels 19*a* to provide a structure, such as exemplified in FIG. 4. The entire roof subassembly is lifted bodily and positioned at the top edges of the upstanding panels which form the walls 11, 12, 13 and 14. Thereafter, a plurality of pipe clamps, such as 80 (FIG. 13), are utilized to snap the edges defined by corner extrusions 62 into the top edges of the panels which form the side walls. This can be visualized from FIG. 4 which shows the same type of connections. As noted above relative to the corners of the casing sill, cutaways 78' (FIG. 13) are provided in ribs 50' of the corner extrusions 62 on the roof so as to permit roof 17 to fit flush against the tops of the panels. In this respect, the ribs, such as 50', of the roof corner extrusions will not conflict with the ribs 50' of the side corner extrusions 62. In other words, at the corners of the roof, cutaways 78' will receive the extreme ends of ribs 50' of the vertical corner extrusions 62. Each pipe clamp 80 essentially consists of a length of pipe 81 having a lower clamping member 82 screwed on at the bottom thereof and an upper clamping member 83 screwed onto the top thereof with a clamping screw 84 threaded into tapped member 86 and having an anvil 85 thereon so that when screw 84 is rotated, anvil 35** will move downwardly to force the roof downwardly on the side walls. While a specific type of pipe clamp has been illustrated, other types of pipe clamps or other types of devices can be used to draw the parts together.

In order to stabilize the mullions 72 against bowing outwardly or inwardly at the ends thereof at which the mullions abut the ribs 50' of the corner extrusion which borders the roof (FIG. 4), an angle connection is provided. In this respect, angles 87 have legs of approximately 1" in length. One of these legs 89 is attached to the web 73 of the mullion 72 by means of a bolt or screw 90. The other leg 91 fits snugly between the inner edges of ribs 50' on the corner extrusion. It can thus be seen that angles 87 prevent the ends of the mullions from moving inwardly or outwardly relative to the corner extrusions. As can be seen from FIG. 4, the angles 87 are provided between the roof mullions and the corner extrusions on the roof and between the upper edges of the side panels and the corner extrusions 62 on the roof. In addition, angles of the same type can be provided between the lower ends of the mullions in the side walls and the casing sill.

In order to stabilize the mullions against bowing inwardly or outwardly relative to the panels, a mullion extension, such as 92 (FIG. 6), may be provided. This extension is the width of web 73 and extends throughout the entire length of the mullion to thereby rigidize it. In constructions where two mullions are in alignment with each other, as would probably be the case between mullions 72 (FIG. 1) which lie at right angles relative to each other at the edges of panels 19*a* and 77, the ends of the extensions 92, which are adjacent to each other, can be mitered so that they do not conflict. The mullion extension can also be used as a mounting flange for components within the housing.

Figure 8:
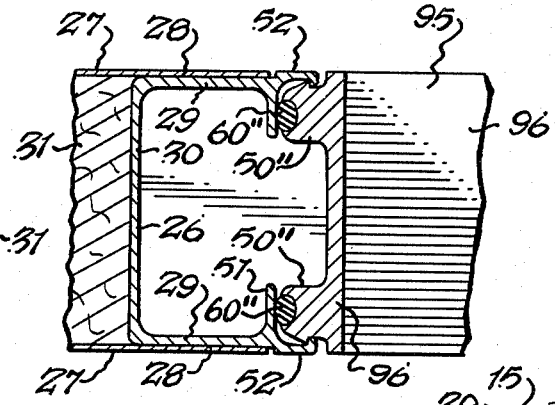
FIG. 8 is a fragmentary cross sectional view taken substantially along line 8—8 of FIG. 1 and showing the structure for framing an opening in a panel.

The various panels which form the sides of housing 10 may have different characteristics, such as different widths, different types of openings therein, doors mounted therein, or removable panels inserted therein. These variations are also achieved by means of structure which provides snap-locking connections, to thereby facilitate fabrication. In this respect, it is to be noted that panel 77 (FIG. 1) and panel 79 (FIG. 2) have openings 93 and 94, respectively, therein. These openings permit equipment to be mounted on the outside of housing 10 and protrude through these openings into the inside of the housing. In addition, an opening, such as 95, may be provided in panel 71. The manner in which the openings are fabricated can be visualized from FIG. 8. In this respect, panel frame extrusions, such as 26 (FIG. 5), are located within panel 71 to define the opening 95. There are four frame extrusions 26 which are placed together in the shape of a rectangle with mitered corners therebetween. The skin of the panel is cemented to the legs 29 of the frame extrusions in the same manner as described above in FIG. 7. Thereafter, a cap extrusion 96, FIG. 8, which is essentially a mullion with the ribs 50″ on opposite ends of one side removed, is snapped into locking engagement with the flanges 52 of the panel frame extrusion 26. The mode of attachment is identical to that described above relative to FIGS. 7, 7A and 7B.

Selectively removable panels 97 and 97′ are also provided in sides 11 and 13, respectively. Panel 97 (FIG. 6) includes frame edge extrusions 99 having a cross sectional configuration shown in FIG. 6. These edges extend around the entire periphery of the panel and meet at mitered welded corners. Metal skins 100 are cemented to the frame edge extrusion on the opposite sides 98 of the legs 88. The panel includes insulating material 101. Panel 103 (FIG. 1) has the usual frame extrusion 26 as an edge thereof, and mullion 72 is snap-locked into the frame (FIG. 6) in the manner described above. A panel opening extrusion 104, of the cross section shown in FIG. 6, has a snap-lock construction at its ends 105 which is identical to flanges 52 (FIG. 7). With this construction the panel opening extrusion 104 can be snap-locked into engagement with the mullions 72 on the panels 103 and 106 on opposite sides of removable panel 97. In addition, a panel opening extrusion, such as 104, is snapped into engagement with the roof corner extrusion 62, and the casing sill extrusion 39 so as to provide an opening which is bordered by extrusions 104. Where these extrusions meet at the corners of the panel opening, they may be mitered. A gasket seal 107 is located as shown between side portions 109 and 110 (FIG. 6). To secure panel 97 in position, screws 111 are threaded through extrusion 99 into extrusion 104 on suitable centers, such as 12″. Panel 97 may be removed, as required, by unfastening screws 111. While screws have been shown, bolts may also be used.

Figure 14:
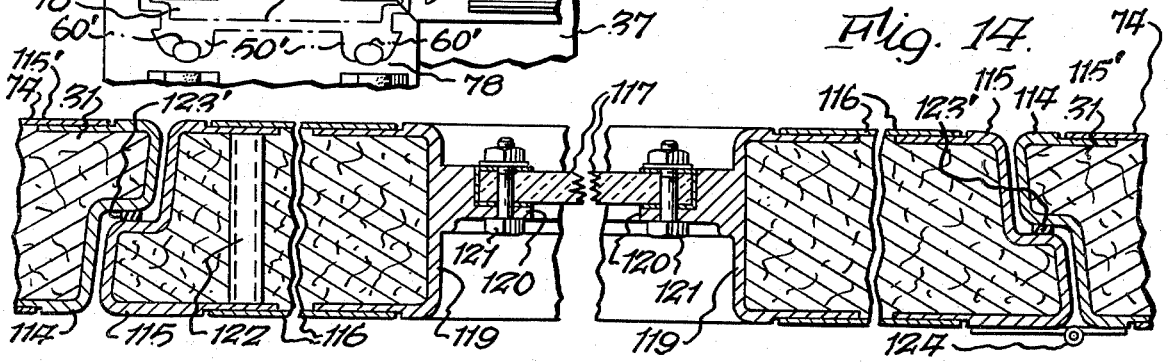
FIG. 14 is a fragmentary cross-sectional view taken along line 14—14 of FIG. 1 and showing the door structure associated with one of the panels.

A door 112 is installed in panel 74 (FIG. 1). The manner in which it is done is shown in FIG. 14. An extrusion 114 is secured to skin 115′ of the panel. The same extrusion reversed, at 115, forms the door frame. Extrusion 115 extends about the entire periphery of the door frame, and the corners are mitered and welded. Metal skin 116 forms the outside of the door and covers the entire door except where window 117 is located. The border of window 117 consists of window frame extrusion 119 forming a square opening, and the corners are mitered and welded. Extrusions 119 are secured to skin 116 adhesively, as shown. Window 117 has its outer edge mounted on ledge 120 of extrusion 119 and is secured thereto by bolts 121. If desired, a frame may bear on the edges of window 117 so that these edges of the window are sandwiched between the frame and ledge 120, and bolts, such as 121, need not pass through the window, but merely draw the frame down onto the window. In this modification the bolts are all located outside of the window perimeter. Suitable adhesive is used to effect sealing. A latch sleeve 122 is mounted on door frame extrusion 115 to secure latch handles 123 on the door. A suitable gasket 123′ is located between door frame opening defined by extrusions 114 and the edge of the door frame defined by extrusions 115. A piano hinge 124 fastens extrusions 114 and 115 as shown.

It will be appreciated that all of the panels have suitable internal bracing to provide them with the required strength. The bracing varies with the size and function of the panels. By way of example, braces 127 are shown in dotted lines in one of the panels 19*a* in FIG. 1. The braces are preferably of I-shaped cross section (FIG. 15) and they are preferably mounted on about twelve inch centers. During fabrication the opposite ends of braces 127 are secured to the frame, as by welding, and the skins 27 are thereafter adhesively secured to the outside surfaces 129 of the flanges 130 and to the frame.

While all of the extrusions and skin are preferably aluminum, it will be understood that any other suitable materials may be used. In addition, it is preferred that pyramidal corner caps 128 (FIG. 2) be installed at the corners to provide protection against leakage. Caps 128 are formed of three planar triangular sheets of metal meeting at 90°. Caps 128 are secured in position with pop-rivets, and suitable cement is used for sealing.

It can thus be seen that the improved mullion and housing assembly of the present invention is manifestly capable of achieving the above enumerated objects, and while preferred embodiments of the present invention have been disclosed, it will be appreciated that the present invention is not limited thereto but may be otherwise embodied within the scope of the following claims.

What is claimed is:

1. A housing structure comprising a plurality of panels having first snap-locking means on a plurality of sides thereof for locking engagement with adjacent members, base means having second snap-locking means for receiving first snap-locking means on first sides of said panels in locking engagement, a roof having third snap-locking means for receiving first snap-locking means on second sides of said panels in locking engagement, fourth snap-locking means for coacting with first snap-locking means on third and fourth sides of said panels for locking said panels in side-by-side relationship to form sides of said housing structure, said roof comprising a plurality of second panels having fifth snap-locking means on a plurality of sides thereof, and sixth snap-locking means for coacting with said fifth snap-locking means for locking said second panels in side-by-side relationship.

2. A housing structure as set forth in claim 1 wherein said sixth snap-locking means comprise mullions.

3. A mullion comprising a central body portion having opposite sides, first and second snap-locking means extending outwardly from opposite sides of said central body portion for attaching said mullion to adjacent members with a locking connection, said first and second snap-locking means comprising first and second pairs of elongated ribs extending outwardly from spaced portions of said central body portion, said ribs having inner ends proximate said central body portion and outer ends remote from said central body portion, elongated compressible sealing members mounted on said outer ends of said elongated ribs and extending lengthwise of said mullion for effecting a sealing engagement with said adjacent members, each pair of said ribs having first sides facing toward each other and second sides facing away from each other, ridge means on said second sides of said ribs for receiving latching members of said adjacent members in latching engagement, and cam surface means on said second sides between said sealing members and said ridge means for guiding said latching members into latching engagement with said ridge means.

4. A mullion as set forth in claim 3 wherein said cam surface means comprise convexly curved portions of said ribs.

5. A mullion as set forth in claim 3 including elongated grooves in said outer ends of said ribs, said elongated compressible sealing members having inner portions located in said grooves and outer portions extending outwardly beyond said grooves.

6. A mullion as set forth in claim 5 wherein said cam surface means comprise convexly curved portions of said ribs.

7. A mullion as set forth in claim 3 including mullion extension means located on the opposite side of certain of said ribs from said central body portion and in substantial alignment with said central body portion for stabilizing said mullion against bowing in a direction in line with the width dimension of said central body portion.

8. A panel for attachment to a mullion comprising a plurality of frame members defining the outer periphery of said panel, panel skin means extending between said frame members, said frame members each comprising a channel including a web and a pair of substantially parallel legs extending outwardly from said web, first flange means spaced from said web and extending inwardly toward each other from said legs for providing sealing engagement with an adjacent member, and snap-locking means for locking engagement with said adjacent member comprising second flange means attached to said legs on the opposite sides of said first flange means from said web.

9. A panel for attachment to a mullion as set forth in claim 8 wherein said frame members are located on all outer edges of said panel.

10. A panel for attachment to a mullion as set forth in claim 8 wherein said second flange means include first outer surface means, and wherein said legs include second outer surface means for receiving the outer edge portions of the inner face of said panel skin means in face-to-face relationship, said second outer surface means being relieved in an amount such that the outer surface of said panel skin means is substantially flush with the first outer surface means of said second flange means.

11. A panel for attachment to a mullion as set forth in claim 8 wherein said second flange means comprise extensions of said legs which extend in substantially the same direction as said legs.

12. A panel for attachment to a mullion as set forth in claim 11 wherein said snap-locking means comprise latch means on said second flange means for effecting said locking engagement, said latch means comprising projections facing inwardly at the outer ends of said second flange means.

13. A panel-mullion assembly comprising a mullion and first and second panels having latching members mounted on opposite sides of said mullion, said mullion comprising a central body portion having opposite sides, first and second snap-locking means extending outwardly from opposite sides of said central body portion for attaching said mullion to said first and second panels with a locking connection, said first and second snap-locking means comprising first and second pairs of elongated ribs extending outwardly from spaced portions of said central body portion, said ribs having inner ends proximate said central body portion and outer ends remote from said central body portion, elongated compressible sealing members mounted on said outer ends of said elongated ribs and extending lengthwise of said mullion, each pair of said ribs having first sides facing toward each other and second sides facing away from each other, ridge means on said second sides of said ribs for receiving said latching members of said first and second panels in latching engagement, and cam surface means on said second sides between said sealing members and said ridge means for guiding said latching members into latching engagement with said ridge means, each of said panels comprising a plurality of frame members defining the outer periphery of said panel, said frame members each comprising a channel including a web and a pair of substantially parallel legs extending outwardly from said web, first flange means spaced from said web and extending inwardly toward each other from said legs for providing sealing engagement with said elongated compressible sealing members, and said latching members comprising snap-locking means for locking engagement with said elongated ribs comprising second flange means attached to said legs on the opposite sides of said first flange means from said web, and projections facing inwardly at the outer ends of said second flange means for engaging said ridge means in locking relationship after traveling over said cam surface means.

14. A panel-mullion assembly as set forth in claim 13 including panel skin means extending between said frame members, said second flange means including first outer surface means, and said legs including second outer surface means for receiving the outer edge portions of the inner face of said panel skin means in face-to-face relationship, said second outer surface means being relieved in an amount such that the outer surface of said panel skin means is substantially flush with said first outer surface means of said second flange means.

15. A panel-mullion assembly as set forth in claim 14 wherein said frame members are located on all outer edges of said panel.

16. A panel-mullion assembly as set forth in claim 13 including mullion extension means located on the opposite side of certain of said ribs from said central body portion and in substantial alignment with said central body portion for stabilizing said mullion against bowing in a direction in line with the width dimension of said central body portion.

17. A panel-mullion assembly comprising a mullion and first and second panels having latching members mounted on opposite sides of said mullion, said mullion comprising a central body portion having opposite sides, first and second snap-locking means extending outwardly from opposite sides of said central body portion for attaching said mullion to said first and second panels with a locking connection, said first and second snap-locking means comprising first and second of elongated rib means extending outwardly from opposite sides of said central body portion, said rib means having inner ends proximate said central body portion and outer ends remote from said central body portion, elongated compressible sealing members mounted on said outer ends of said elongated rib means and extending lengthwise of said mullion, each of said rib means having sides between said first and second ends, ridge means on said sides of said rib means for receiving said latching members of said first and second panels in latching engagement, and cam surface means on said sides between said sealing members and said ridge means for guiding said latching members into latching engagement with said ridge means, each of said panels comprising a plurality of frame members defining the outer periphery of said panel, said frame members including webs and legs extending outwardly from said webs, first flange means spaced from said webs and extending transversely to said legs for providing sealing engagement with said elongated compressible sealing members, and said latching members comprising snap-locking means for locking engagement with said elongated ribs comprising second flange means attached to said legs on the opposite sides of said first flange means from said webs, and projections facing toward said ridge means at the outer ends of said second flange means for engaging said ridge means in locking relationship after traveling over said cam surface means.

* * * * *